US008876547B1

(12) United States Patent
Tsai

(10) Patent No.: US 8,876,547 B1
(45) Date of Patent: Nov. 4, 2014

(54) SOCKET FOR LED LIGHT STRING

(71) Applicant: Tung-Ling Wang, Taichung (TW)

(72) Inventor: Chang-Fu Tsai, Taichung (TW)

(73) Assignee: Tung-Ling Wang, Taichung (TW)

( * ) Notice: Subject to any disclaimer, the term of this patent is extended or adjusted under 35 U.S.C. 154(b) by 54 days.

(21) Appl. No.: 13/892,308

(22) Filed: May 13, 2013

(30) Foreign Application Priority Data

Apr. 23, 2013 (TW) ..... 102207372 U

(51) Int. Cl.
*H01R 13/506* (2006.01)
*H01R 13/504* (2006.01)
*H01R 13/514* (2006.01)
*H01R 13/658* (2011.01)

(52) U.S. Cl.
CPC ..... *H01R 13/504* (2013.01); *Y10S 439/906* (2013.01); *Y10S 439/904* (2013.01)
USPC ..... 439/465; 439/686; 439/701; 439/906; 439/904; 439/425; 439/95; 362/230; 362/249.18; 362/238; 362/654; 29/872

(58) Field of Classification Search
USPC ..... 439/893, 56, 280, 283, 380, 620.02, 439/620.21, 890; 362/640, 647, 649, 362/249.06, 249.14, 249.01, 249.02, 362/249.11, 249.16, 231, 652–656; 29/872
See application file for complete search history.

(56) References Cited

U.S. PATENT DOCUMENTS

| | | | | |
|---|---|---|---|---|
| 5,121,310 | A * | 6/1992 | Ahroni | 362/238 |
| 5,460,539 | A * | 10/1995 | Gallone | 439/425 |
| 7,004,767 | B2 * | 2/2006 | Kim | 439/95 |
| 7,575,339 | B2 * | 8/2009 | Hung | 362/230 |
| 8,070,347 | B1 * | 12/2011 | Lin | 362/654 |
| 8,568,015 | B2 * | 10/2013 | Chen | 362/654 |
| 2012/0302097 | A1 * | 11/2012 | Yang | 439/620.02 |

* cited by examiner

*Primary Examiner* — Dameon E Levi
*Assistant Examiner* — Matthew T Dzierzynski
(74) *Attorney, Agent, or Firm* — Andrew C. Chang

(57) ABSTRACT

A socket is provided for an LED light string and is formed by jointing two unsymmetrical casing members through thermal fusion by application of ultrasonic wave to thereby securely combine with electrical wires and a luminous element. The first and second casing members are provided with raised-and-recessed inter-engageable structures including holes and protrusions and multiple tiny bosses that is thermally fusible through application of ultrasonic wave for adhesion purposes. The first casing member includes a receiving channel for receiving electrical wires therein and the second casing member includes hold-down blocks and holding blocks for holding the electrical wires in position.

8 Claims, 5 Drawing Sheets

SOCKET FOR LED LIGHT STRING

BACKGROUND OF THE INVENTION

1. Field of the Invention

The present invention relates to a socket for an LED (Light-Emitting Diode) light string, and in particular to a socket structure that is thermally fusible through application of ultrasonic wave for easy realization of machine-based automatic assembling.

2. The Related Arts

Conventional light strings are generally manufactured with manual assembling. One the known light strings that are manually assembled comprises, in structure, generally five components including a light bulb, a bulb holder, a socket, conductive terminals, and electrical wires. Assembly is carried out by first stamping and bending the terminals to position against the electrical wires. Then, the sub-assembly of the terminals and the electrical wires is fit into the socket. The light bulb and the bulb holder are assembled together and the holder and the socket are coupled to complete the assembly of the light string.

Another known form of light string comprises a light bulb, solders, adhesives, electrical wires, and an enclosure film. Firstly, the insulation jackets of the electrical wires are partially stripped off to partially expose conductive cores of the wires. Conductive terminals of the bulb are soldered to the exposed conductive cores of the wires and covered with the adhesive for improved security. Finally, enclosure is effected by using the enclosure film to securely fix a lower portion of the bulb and the electrical wires together.

Manual assembling is generally time consuming and human errors often occur in carrying out the assembling operation, leading to high rate of defect products. In addition, the components used and the process of assembling involved are relatively numerous, leading to inevitable increase of material cost and assembling operations and thus making the manufacturing management complicated.

Prior art reference is also known, such as U.S. patent application Ser. No. 13/423,882. The present invention is made to provide further improvement over U.S. patent application Ser. No. 13/423,882.

SUMMARY OF THE INVENTION

An object of the present invention is to provide a socket for an LED light string that is formed by jointing first and second casing members that are unsymmetrical and are fixed together through thermal fusion by application of ultrasonic wave to thereby securely combine with electrical wires and a luminous element. Assembling operation can be carried out by feeding parts with machines so that efficient manufacture and assembling can be done with automatized machines, requiring no human assembling. Thus, this is particularly suitable for mass production with reduced cost and maintains high yield rate of the final products.

Another object of the present invention is to provide a socket for a light string, which comprises first and second casing members respectively forming inter-engageable raised-and-recessed structures including holes and corresponding protrusions and multiple tiny bosses that are thermally fusible by application of ultrasonic wave for adhesion purposes. The first casing member forms a channel for receiving electrical wires and the second casing member forms wire hold-down blocks and holding blocks that are engageable and hold the electrical wires in position so that when the casing members are fused together with the application of ultrasonic wave, the insulation jacket or conductive core of the electrical wire that is in contact with terminals of an LED luminous element is securely pressed down and fixed to improve resistance against stretching of the wires and prevent the luminous element from being easily detached.

A further object of the present invention is to provide a socket for a light string that comprises first and second casing members that are respectively provided with projecting portions that are combinable with each other. The projecting portion of the first casing member forms two grooves for receiving conductive terminals of an LED based luminous elements therein to electrically connect to conductive cores of electrical wires and a rib arranged between the two grooves. The second casing member comprises a slot corresponding to and receiving the rib therein. The rib divides the channel of the first casing member into two separated sections thereby providing an insulation effect between the conductive cores of the electrical wires.

A further object of the present invention is to provide a socket of a light string, wherein a first casing member forms a wire receiving channel that has a C-shaped cross-section that is greater than a semicircle so as to clamp and retain a wire in position when the wire is placed into the channel for precisely positioning the components during the operation of ultrasonic fusion.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

A detailed description will be given to discuss the structural features and other advantages and objects of the present invention with reference to the accompanying drawings.

Figure 1:
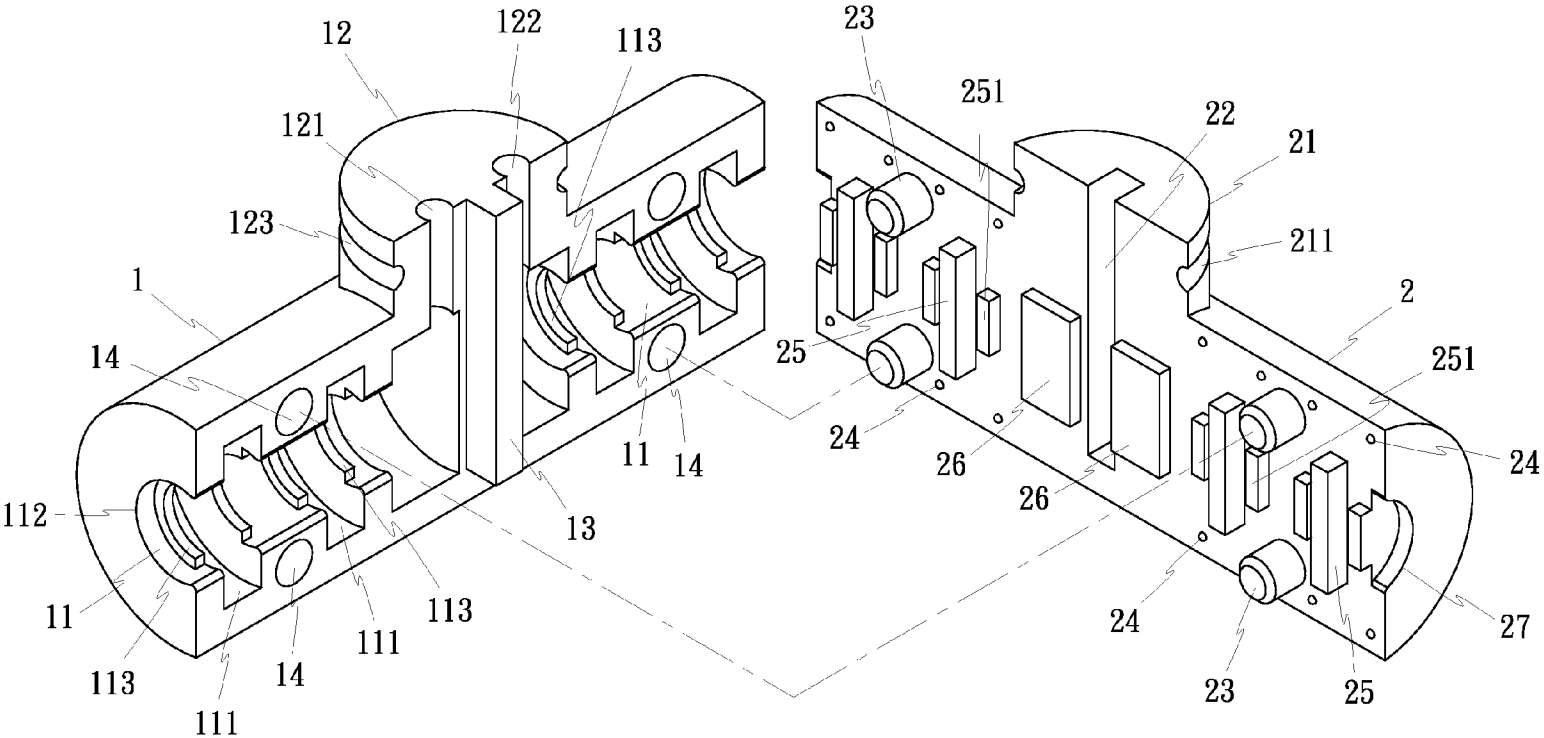
FIG. 1 is an exploded view of a socket according to the present invention.
Figure 2:
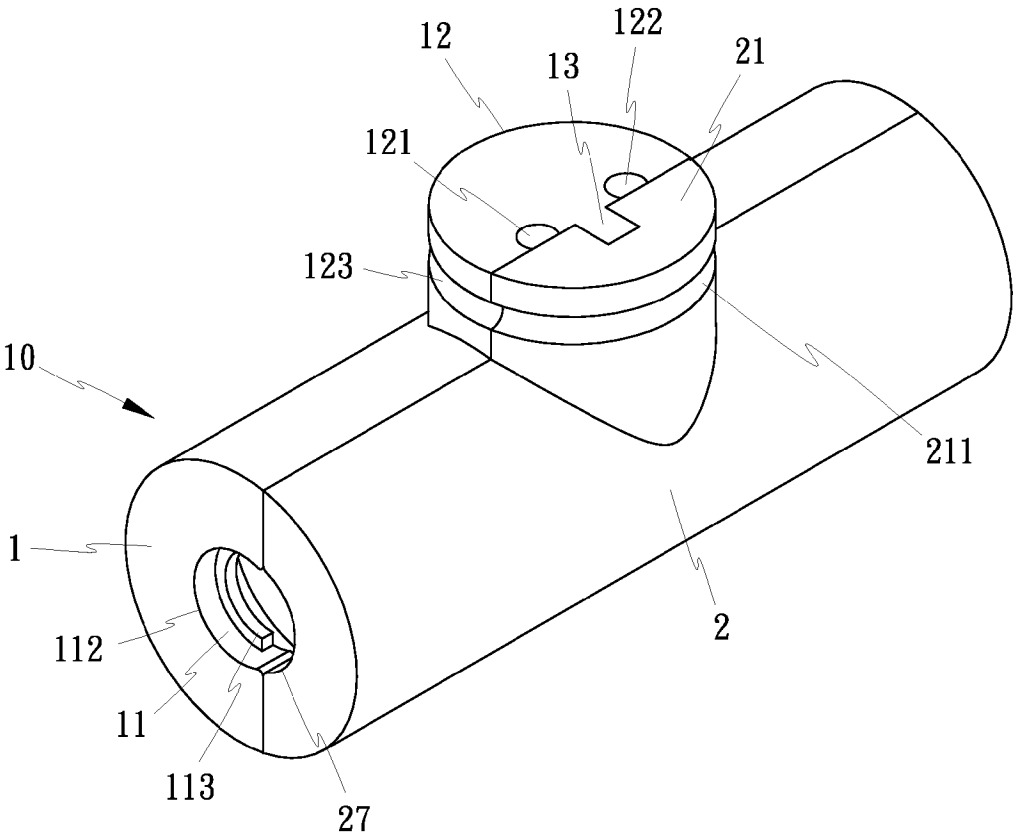
FIG. 2 is a perspective view showing the socket of the present invention in an assembled form.
Figure 3:
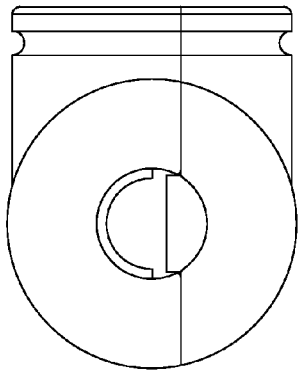
FIG. 3 is a side elevational view, in an assembled form, showing the socket according to the present invention.
Figure 4:
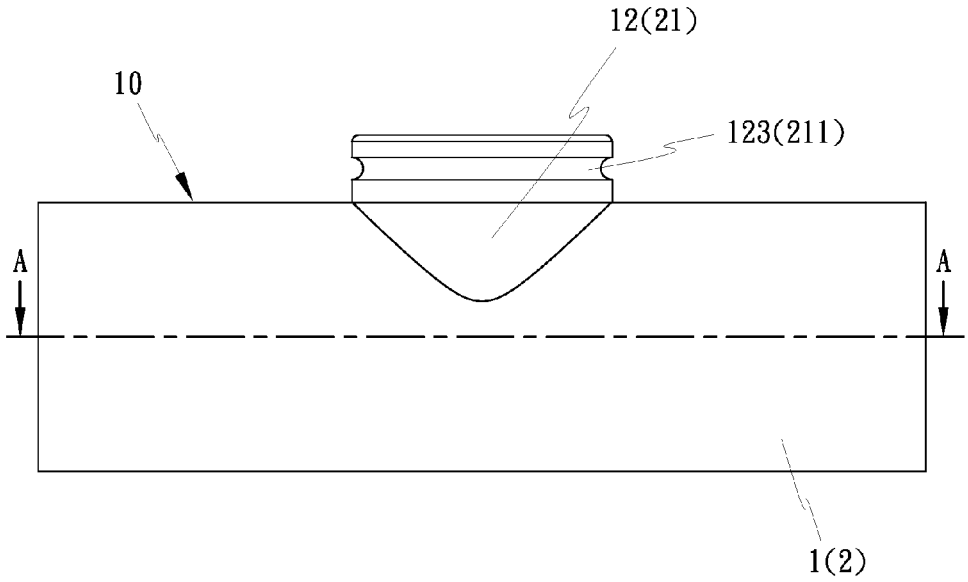
FIG. 4 is a front view, in an assembled form, showing the socket according to the present invention.
Figure 5:
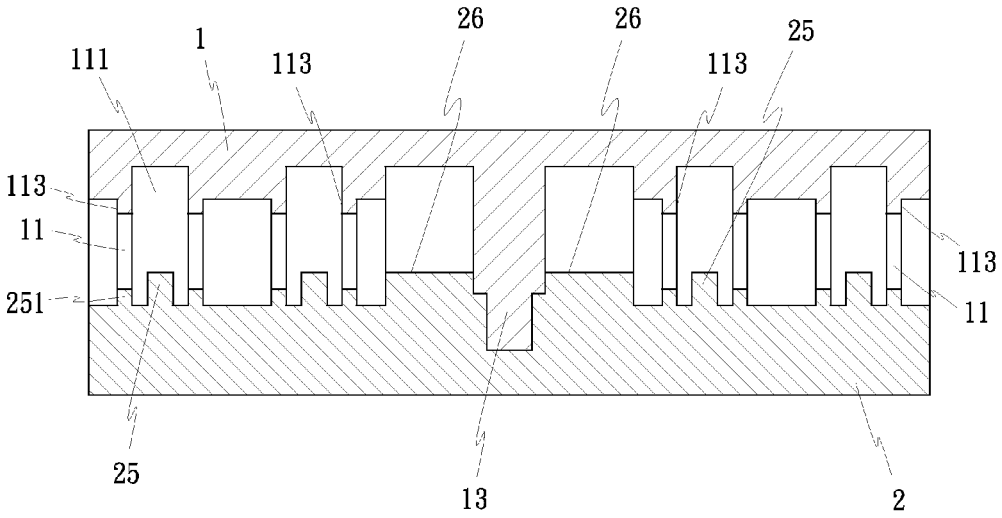
FIG. 5 is a cross-sectional view of the socket according to the present invention in an assembled form.

As shown in FIG. 1, the present invention provides a socket for an LED light string. The socket is formed by jointing a first casing member 1 and a second casing member 2 that are unsymmetrical to each other and are made of a thermally fusible material, preferably a material that is fused by application of ultrasonic wave, such as plastics, so as to securely joint to each other. Preferably, the socket is of a substantially cylindrical form.

The first casing member 1 is a channel-like member having a first surface, which is preferably planar, facing the second casing member 2. A wire receiving channel 11 is formed in the first surface of the first casing member 1 and extends in an axial direction of the socket. A projecting portion 12, preferably a semi-cylindrical portion, which constitutes partially a sideway projection of the socket, is formed on and extends from a curved surface of the first casing member 1. The projecting portion 12 has a planar surface that continues from and is substantially flush with the first surface of the first casing member 1. The planar surface of the projecting portion 12 forms two grooves 121, 122 extending from a free end of the projecting portion 12 to the interior of the channel 11 so as to be in communication with the channel 11. A raised rib 13 is formed on the planar surface of the projecting portion 12 and is located between and separating the two grooves 121, 122 to provide an effect of isolating the two grooves 121, 122 from each other. The rib 13 is arranged to extend through the channel 11 so as to divide the channel 11 into two separate sections. A plurality of retention holes 14 is formed in the first surface of the first casing member 1.

The second casing member 2 is of a lid-like member having a shape or configuration that is complementary to the first casing member 1, whereby when the first and second casing members 1 and 2 mate and joint to each other, a complete I configuration of the socket is provided (as shown in FIGS. 2-5). The second casing member 2 has a second surface, which is preferably planar and is surface-to-surface engageable with the first surface of the first casing member 1 to close the channel 11. The second casing member 2 has a curved surface on which a projecting portion 21 is formed to correspond to the projecting portion 12 of the first casing member 1, whereby when the first and second casing members 1, 2 are jointed to each other to form the socket, the curved surfaces of the first and second casing members 1, 2 collectively form a circumferential surface of the socket and the projecting portions 12, 21 mate each other to form a sideway projection of the socket. The projecting portion 21 of the second casing member 2 has a planar surface mating the planar surface of the projecting portion 12 of the first casing member 1 and comprising a slot 22 that corresponds to and receives the rib 13 of the first casing member 1 therein when the first and second casing members 1, 2 are jointed to each other. A plurality of retention protrusions 23 is formed on the second surface of the second casing member 2 and is receivable in the retention holes 14 of the first casing member 1. A plurality of tiny bosses 24 is also formed on the second surface of the second casing member 2 to be in contact with the first surface of the first casing member 1 when the first and second casing members 1, 2 are jointed and is fusible by the application of ultrasonic wave to securely fix the first and second casing members 1, 2 together.

Figure 6:
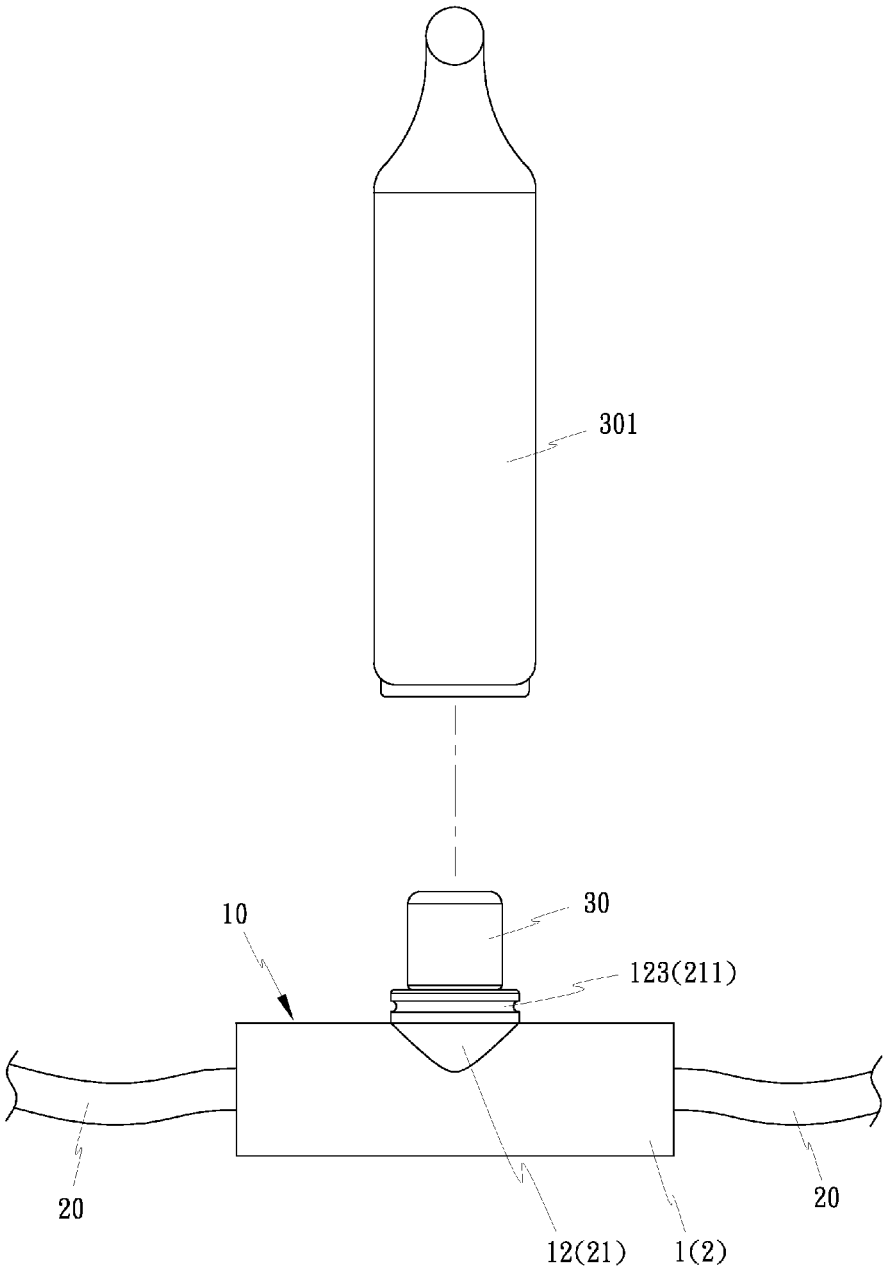
FIG. 6 is a schematic view illustrating the socket according to the present invention assembled with an LED-based luminous element, a cover, and electrical wires.

As shown in FIG. 6, the first casing member 1 and the second casing member 2 are jointed to each other by means of inter-engageable raised-and-recessed structures formed thereon. Before the casing members 1, 2 are jointed to each other, two electrical wires 20 and a luminous element 30 are first placed in the first casing member 1 and then the second casing member 2 is jointed to the first casing member 1 by placing the second casing member 2 as a lid on the first casing member 1 and then applying ultrasonic wave to fuse and joint the first casing member 1 and the second casing member 2.

The projecting portions 12, 21 of the first and second casing members 1, 2 are respectively provided with circumferentially extending recesses 123, 211 that, when the casing members 1, 2 are jointed together to form the socket, collectively form a circumferential recess around the sideway projection of the socket that provides a tenon-mortise like connection. The circumferential recess of the sideway projection of the socket receives a corresponding rim of a cover 301 of the luminous element 30 so as to retain the cover 301 on the sideway projection of the socket.

Besides the inter-engageable raised-and-recessed structures, the first casing member 1 is provided, on an interior surface of the wire receiving channel 11 thereof, with a plurality of spaced notches 111. The second casing member 2 is provided with a plurality of wire hold-down blocks 25 respectively corresponding to the notches 111 of the first casing member 1. With the wires 20 being placed in the channel 11 of the first casing member 1, when the second casing member 2 is mounted to the first casing member 1, the wire hold-down blocks 25 compress and deform the insulation jackets of the wires 20 to achieve a bite-to-fix means making the wires 20 curved in a serpent like form to improve the resistance against stretching of the wires 20 and also to limit twisting of the wires 20 in the wire receiving channel 11 and also provides resistance against the twisting force for the twisting of the wires 20.

The second casing member 2 is also provided with two holding blocks 26 on two sides of the slot 22. The holding blocks 26 are used to forcibly press and hold the conductive terminals of the luminous element 30 and the wires 20 to provide an excellent press-and-hold effect so as to prevent the luminous element 30 from being easily removed and to improve resistance against stretching of the wires 20 when the conductive cores of the wires 20 are electrically connected to the luminous element 30.

The channel 11 of the first casing member 1 is preferably of a cross-sectional shape that is a major circular sector or a C-shape 112 that is greater than a semicircle or, in other words, having a central angle greater than 180 degrees, so that the wire 20, when placed in the channel 11, can be temporarily held by the C-shape. Thus, the wire 20 can be initially held in position for facilitating subsequent handling by machines. The second casing member 2 can then mounted to the first casing member 1, followed by thermal fusion with ultrasonic wave. The second casing member 2 may be provided with a sector-shaped opening 27 that is complementary to the C-shaped cross-section 112 of the channel 11 and thus smaller than a semicircle so that the opening 27 can be combined with the C-shaped cross-section 112 of the channel 11 to clamp the wire 20 from opposite sides. The C-shaped cross-section 112 of the channel 11 and the opening 27 may be properly chamfered to reduce undesired abrasion with the insulation jackets of the wires 20.

The wire receiving channel 11 of the first casing member 1 can be further provided, on the interior surface thereof, with a plurality of semi-circular flanges 113, each defining a concave recess substantially concentric with the channel 11 but having a smaller inside diameter. The flanges 113 are respectively located on two sides of each notch 111. After the casing members 1, 2 are fused together by ultrasonic wave, the flanges 113 compress and press down the insulation jackets of the wires 20 so as to improve the resistance of the wires 20 against outward stretching.

Besides the inter-engageable raised-and-recessed structures provided on the first and second casing members 1, 2, the wire receiving channel 11 of the first casing member 1 is further provided, in the interior surface thereof, with notches 111 that are spaced from each other and the second casing member 2 is provided with corresponding wire hold-down blocks 25. The wire hold-down blocks 25 can be used to press down and compress the insulation jackets of the wires 20 to form a multi-tooth "pinching" or "biting" effect to improve the resistance of the wires 20 against outward stretching.

Secondary hold-down blocks 251 may be provided on the second surface of the second casing member 2, preferably on opposite sides of each or some of the wire hold-down blocks 25 to provide additional compression and pressing of the electrical wires 20 and thus further increase the resistance against stretching of the wires 20.

The structure of the present invention is provided for jointing with one wire 20. Thus, as compared to a conventional light string that uses two wires, the wire receiving channel 11 of the present invention is more effective in saving space. As such, the overall size of the socket can be reduced.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A socket for an LED light string, comprising a first casing member and a second casing member that are unsymmetrical to each other and are made of a fusible material;

wherein the first casing member has a first jointing surface in which a wire receiving channel is formed, the first casing member comprising a first projecting portion formed on and extending from a side surface thereof, the first projecting portion forming two grooves and a rib arranged between the two grooves, the rib being arranged to divide the wire receiving channel into two isolated sections, the first casing member comprising retention holes formed in the first jointing surface;

wherein the second casing member has a shape complementary to the first casing member and has a second jointing surface that is jointed to the first jointing surface so that the first and second casing members collectively form the socket, the second casing member comprising a second projecting portion formed on and extending from a side surface thereof, the second projecting portion forming a slot in which the rib of the first projecting portion is receivable, the second casing member comprising a plurality of retention protrusions formed on the second jointing surface to be respectively receivable in the retention holes of the first casing member; and wherein the inter-engageable raised-and-recessed structures provided on the first and second casing members allows electrical wires and a luminous element to be clamped between the casing members, which are then securely fixed together through thermal fusion by application of ultrasonic wave.

2. The socket as claimed in claim 1, wherein when the first and second casing members are jointed to each other to form the socket and the first and second projecting portions are jointed to each other to collectively form a sideway projection of the socket, each of the first and second projecting portions comprising a circumferentially-extending recess, the circumferentially extending recesses being jointed together to form a circumferential recess of the sideway projection for receiving and retaining therein a rim of a cover of the luminous element.

3. The socket as claimed in claim 1, wherein the first casing member comprises a plurality of spaced notches formed in an interior surface of the channel and the second casing member comprises a plurality of hold-down blocks corresponding to the notches.

4. The socket as claimed in claim 1, wherein the second casing member comprises two holding blocks on two sides of the slot.

5. The socket as claimed in claim 1, wherein the channel of the first casing member has a C-shaped cross-section that is greater than a semicircle and the second casing member comprises a sectorial opening that is complementary to the C-shaped channel and smaller than a semicircle.

6. The socket as claimed in claim 1, wherein the second casing member comprises a plurality of bosses that is fusible when subjected to ultrasonic wave for adhesion purposes.

7. The socket as claimed in claim 1, wherein the second casing member comprises secondary hold-down blocks each provided at one side of the hold-down blocks.

8. The socket as claimed in claim 1, wherein the first casing member comprises a plurality of semi-circular flanges formed on an interior surface of the channel.

* * * * *